299-13 SR
12/24/85 XR 4,560,205

United States Patent [19]
Ricketts

[11] Patent Number: 4,560,205
[45] Date of Patent: Dec. 24, 1985

[54] METHOD FOR CONTROL OF GEOMETRY OF FRAGMENTED MASS IN AN SITU OIL SHALE RETORT

[75] Inventor: Thomas E. Ricketts, Grand Junction, Colo.

[73] Assignee: Occidental Oil Shale, Inc., Grand Junction, Colo.

[21] Appl. No.: 628,448

[22] Filed: Jul. 6, 1984

[51] Int. Cl.[4] ..... E21B 43/247; E21C 41/10; C10B 57/20

[52] U.S. Cl. ..... 299/2; 166/251; 166/259; 299/13

[58] Field of Search ..... 166/247, 251, 259; 299/2, 13

[56] References Cited

U.S. PATENT DOCUMENTS

| | | | |
|---|---|---|---|
| 3,611,933 | 10/1971 | Lanning | 166/247 X |
| 3,677,342 | 7/1972 | Silverman | 166/247 |
| 4,027,917 | 6/1977 | Bartel et al. | 299/2 |
| 4,360,233 | 11/1982 | Ricketts | 299/2 |
| 4,372,615 | 2/1983 | Ricketts | 299/13 X |
| 4,378,841 | 4/1983 | Cha | 299/2 X |
| 4,423,908 | 1/1984 | Ricketts | 299/2 |
| 4,440,444 | 4/1984 | Ricketts et al. | 299/2 |
| 4,449,753 | 5/1984 | Ricketts et al. | 166/251 X |

OTHER PUBLICATIONS

Lekas et al., "Fracturing Oil Shale with Nuclear Explosives for In-situ Retorting", *Quarterly of the Colorado School of Mines,* Jul. 1965, pp. 7-30.

*Primary Examiner*—George A. Suchfield
*Attorney, Agent, or Firm*—Christie, Parker & Hale

[57] ABSTRACT

A method for forming an in situ oil shale retort in a subterranean formation containing oil shale is provided. The in situ retort contains a fragmented permeable mass of formation particles within top, bottom, and generally vertically extending side boundaries of unfragmented formation. A lower portion of the fragmented permeable mass of formation particles having a nonlevel top surface is initially formed in the retort. A void space is left within the retort boundaries extending between the nonlevel top surface of the fragmented mass lower portion and a generally horizontally extending free face of an overlying layer of unfragmented formation. Thereafter, the overlying layer of unfragmented formation is explosively expanded into the void space to thereby form the remaining portion of the fragmented mass in the retort. The overlying layer is expanded in a plurality of separate horizontally spaced regions with a time delay between explosive expansion of each successive region. The average vertical distance from the generally horizontal free face of each such region of the layer expanded earlier in the sequence to the nonlevel top surface of the lower portion of the fragmented mass is greater than the average vertical distance from the generally horizontal free face of each such region expanded later in the sequence to the nonlevel top surface of the lower portion of the fragmented mass.

36 Claims, 5 Drawing Figures

METHOD FOR CONTROL OF GEOMETRY OF FRAGMENTED MASS IN AN SITU OIL SHALE RETORT

This invention relates to a method for forming an in situ retort that is substantially filled to its top boundary with a fragmented permeable mass of formation particles.

BACKGROUND OF THE INVENTION

The presence of large deposits of oil shale in the semi-arid, high plateau region of the western United States has given rise to extensive efforts to develop methods for recovering shale oil from kerogen in the oil shale deposits. The term "oil shale" as used in the industry is, in fact, a misnomer; it is neither shale nor does it contain oil. It is a sedimentary formation comprising marlstone deposit containing an organic polymer called "kerogen" which, upon heating, decomposes to produce liquid and gaseous products, including hydrocarbon products. It is the formation containing kerogen that is called "oil shale" herein; the carbonaceous liquid product is called "shale oil".

A number of methods have been proposed for processing oil shale which involve either mining the kerogenbearing shale and processing the shale on the surface or processing the shale in situ. The latter approach is preferable from the standpoint of environmental impact since the spent shale remains in place, reducing the chance of surface contamination and the requirement for disposal of solid wastes. According to both of these approaches, oil shale is retorted by heating the oil shale to a sufficient temperature to decompose kerogen and produce shale oil which drains from the rock. The retorted shale, after kerogen decomposition, contains substantial amounts of residual carbonaceous material which can be burned to supply heat for retorting.

One technique for recovering shale oil includes forming an in situ oil shale retort in a subterranean formation containing oil shale. At least a portion of the formation within the boundaries of the in situ oil shale retort is explosively expanded toward one or more voids excavated in the subterranean formation to form a fragmented permeable mass of formation particles containing oil shale in the retort. The fragmented mass of particles is ignited near the top of the retort to establish a combustion zone. An oxygen-supplying gas is introduced into the top of the retort to sustain the combustion zone and cause it to move downwardly through the fragmented mass. As burning proceeds, the heat of combustion is transferred to the fragmented mass of particles below the combustion zone to release shale oil and gaseous products therefrom in a retorting zone. The retorting zone moves from the top to the bottom of the retort ahead of the combustion zone and the resulting shale oil and gaseous products pass to the bottom of the retort for collection and removal. Recovery of liquid and gaseous products from oil shale deposits is described in greater detail in U.S. Pat. No. 3,661,423 to Donald E. Garrett, which is incorporated herein by this reference.

As used herein, the term "retorting zone" refers to that portion of the retort where kerogen in oil shale is being decomposed to liquid and gaseous products, leaving residual carbonaceous material in the retorted oil shale. The term "combustion zone" refers to a portion of the retort where the greater part of the oxygen in the retort inlet mixture that reacts with the residual carbonaceous material in the retorted oil shale is consumed.

It has been found desirable in some embodiments to have an intact subterranean base of operation above the fragmented permable mass of formation particles in an in situ oil shale retort. Such a base of operation facilitates the drilling of blastholes into underlying formation for forming the fragmented mass in the retort and facilitates ignition over the entire top portion of the fragmented mass. Additionally, having a base of operation above the fragmented mass permits control of introduction of oxygen-supplying gas into the retort, provides a location for testing properties of the fragmented mass, and provides a location for evaluation and controlling performance of the retort during operation.

The base of operation is separated from the retort by a layer of unfragmented formation extending between the top boundary of the retort and the floor of such a base of operation. The layer of unfragmented formation is termed a "sill pillar" which acts as a barrier between the in situ oil shale retort and the base of operation during retorting operations. It is, therefore, important that the sill pillar remain structurally sound, both for supporting the base of operation and for preventing entry of heat and gases into the base of operation during the retorting process.

Techniques for forming an in situ oil shale retort containing a fragmented permeable mass of formation particles and having a sill pillar of unfragmented formation between the top of the fragmented mass and an overlying base of operation are described in U.S. Pat. No. 4,118,071 by Ned M. Hutchins and in U.S. Pat. No. 4,192,554 by Thomas E. Ricketts. U.S. Pat. Nos. 4,118,071 and 4,192,554 are incorporated herein by this reference.

In retorts where no base of operation is provided, the formation overlying the fragmented permeable mass of formation particles extends all the way to the ground surface. In such an embodiment, blastholes can be drilled through the overlying formation and ignition of the fragmented mass of particles can be accomplished from the ground surface. Alternatively, a lateral drift can be provided which opens into the top of the retort through a side boundary. In this instance, ignition of the fragmented mass can be accomplished by introducing hot ignition gas through the lateral drift.

When unfragmented formation is explosively fragmented and expanded, e.g., toward a void space when forming a retort, it increases in bulk due to void spaces in interstices between the particles. The maximum expansion of an oil shale formation into an unlimited void results in a fragmented mass of oil shale particles having an average void fraction of about 40 percent; that is, about 40 percent of the total volume occupied by the fragmented mass is void space between the particles.

A "limited void" is one where the void space available for explosive expansion is less than needed for free bulking of the formation expanded toward that void. Thus, if a void has an excavated volume less than about 40 percent of the total of the volume of the void plus the volume occupied by formation explosively expanded, it is necessarily a limited void. It has been found that factors in addition to total available void, such as the geometry of the void, can make a void "limited" even though the total available void may appear sufficient for free bulking. For example, voids that have an excavated volume up to as high as 80 percent of the total volume of the void plus the volume occupied by formation explosively expanded can act as a limited void.

When oil shale is explosively expanded toward a limited void, the void fraction of the fragmented mass of particles formed can be no more than permitted by the available void space of the void and, in some instances, has been found to be less. It is believed that the void fraction of the fragmented mass can be less than the available void space provided by such a limited void because when oil shale is explosively expanded toward the void, gases from the detonation may not have full opportunity to act on the oil shale particles before such particles reach obstructions, such as adjacent walls, a face opposite to the expanding formation, or oil shale expanding from the opposite sides of the void.

Thus, when formation is expanded toward one or more limited voids for forming an in situ oil shale retort, a void space can remain in the retort between the surface of the fragmented mass of particles formed and overlying unfragmented formation.

When a void space is between overlying unfragmented formation and the fragmented mass in a retort, heating of the overlying formation during ignition and/or during retorting operations can result in spalling or sloughing of formation into the retort. This can prolong the ignition process and, in some instances, can make ignition very difficult and result in reduced product yield. Additionally, sloughed formation can be heated sufficiently to consume at least a portion of the oxygen being supplied to the retort during retorting operations. This can change the desired material balance in the retort and deleteriously affect the amount of products recovered. Furthermore, sloughing can disturb aquifers and cause more water inflow into the retort than desired.

When the retort has an overlying sill pillar and a void space exists between the top of the fragmented mass in the retort and the bottom of the sill pillar, i.e., the top boundary of the retort, sloughing of formation from the bottom of the sill pillar can weaken it. If the sloughing is sufficient, the sill pillar can lose its structural integrity, thus rendering the base of operation unsafe for occupancy.

It is therefore desirable to provide a method for forming an in situ oil shale retort containing a fragmented permeable mass of formation particles that substantially completely fills the retort to its top boundary of overlying unfragmented formation.

SUMMARY OF THE INVENTION

This invention relates to a method for explosively expanding a layer of unfragmented formation downwardly toward a generally horizontal free face that overlies a void space having a nonlevel bottom surface to thereby substantially completely fill the void space and the volume originally occupied by the layer with a fragmented permeable mass of formation particles. The method includes the steps of determining the vertical distance from each of a plurality of locations on the generally horizontal free face to the nonlevel bottom surface of the void space to thereby determine the shape of the void space. The layer of unfragmented formation is then explosively expanded in a plurality of separate horizontally spaced regions with a time delay between explosive expansions in the sequence. The average vertical distance from the generally horizontal free face of such a region expanded earlier in the sequence to the void space bottom surface is greater than the average vertical distance from the generally horizontal free face of any such region expanded later in the sequence to the void space bottom surface.

DRAWINGS

These and other features, aspects and advantages of the present invention will become more apparent when considered with respect to the following detailed description, appended claims, and accompanying drawings wherein:

DETAILED DESCRIPTION

Figure 1:
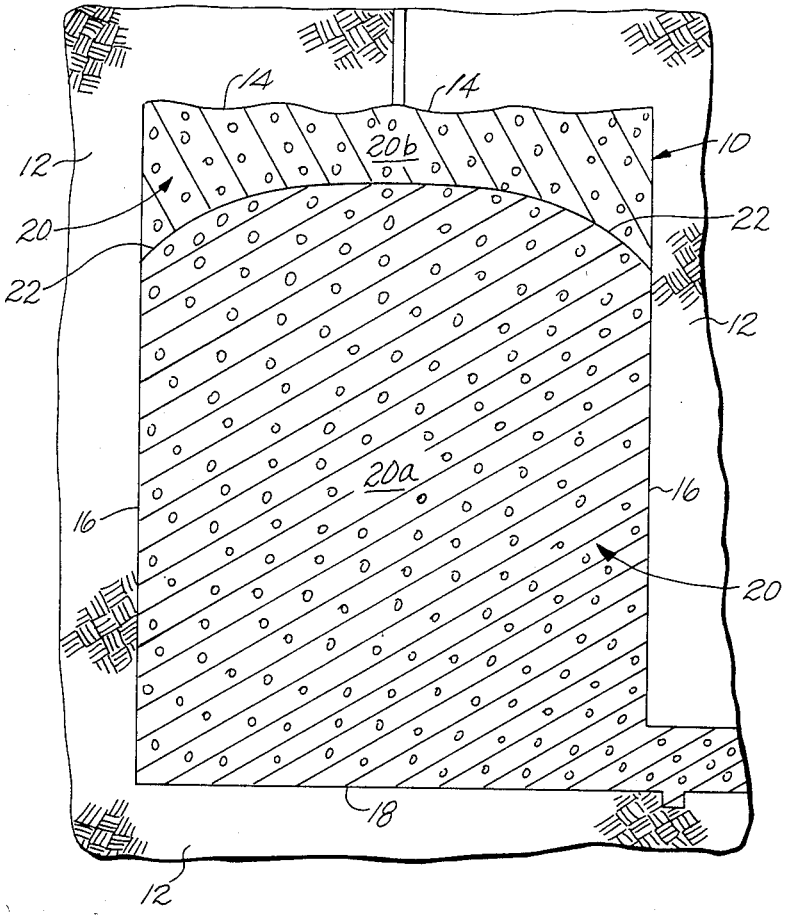
FIG. 1 is a semi-schematic, vertical, cross sectional view of one embodiment of an in situ oil shale retort prepared in accordance with practice of principles of this invention filled substantially to its top boundary with a fragmented permeable mass of formation particles containing oil shale.

Referring to FIG. 1, there is shown a semi-schematic, vertical, cross-sectional view of one embodiment of an in situ oil shale retort 10 prepared in accordance with practice of principles of this invention. In an exemplary embodiment, the in situ retort can be square or rectangular in horizontal cross section, however, retorts having other shapes can be formed if desired.

The retort is in a retort site in a subterranean formation 12 containing oil shale and has a relatively flat, generally horizontal top boundary 14, generally vertically extending side boundaries 16, and a bottom boundary 18 of unfragmented formation.

A fragmented permeable mass of formation particles 20 is contained within the retort boundaries. As is decribed below in greater detail, the fragmented mass 20 comprises two portions, a lower portion **20*a* called the "principal portion" which extends from the bottom boundary to an elevation below the top boundary and an upper portion 20*b* called the "minor" portion. The upper or "minor" portion 20*b* extends from the top surface of the principal portion to the top boundary 14** of the retort.

In the illustrated embodiment the principal portion of the fragmented mass has a dome shaped top surface, as is shown by the line 22. The highest elevation of the dome is near the center of the retort and its lowest elevation is adjacent the retort side boundaries. The minor portion **20*b* of the fragmented mass extends from the surface 22 of the principal portion 20*a* all the way to the top boundary 14. Therefore, the retort 10 provided in accordance with practice of principles of this invention is substantially filled to its top boundary 14 with the fragmented mass of formation particles 20, i.e., there is substantially no void space between the top surface of the fragmented mass in the retort and the top boundary 14**.

As was mentioned above, when a void space exists in a retort between the surface of the fragmented mass and overlying unfragmented formation, problems can arise both during retort ignition and during retorting due to sloughing of overlying unfragmented formation into the retort. Since no such void space exists in a retort, such as the retort 10, formed in accordance with practice of this invention, these problems are essentially eliminated.

The process provided in accordance with practice of this invention for forming the retort 10 includes excavating one or more voids into the subterranean formation within the retort boundaries while leaving one or more zones of unfragmented formation adjacent the voids. The zone or zones of unfragmented formation are then explosively expanded toward the void or voids to form the principal portion 20*a* of the fragmented permeable mass of formation particles in the retort.

After the principal portion of the fragmented mass is formed, a void space exists between the top surface of the principal portion and overlying unfragmented formation. The shape of such a void space is determined, for example, by measurement. Thereafter, a layer of unfragmented formation overlying the void space is explosively expanded downwardly into the void space to thereby form the remaining portion 20*b* of the fragmented mass 20. As is described below in greater detail, a key feature of practice of this invention relates to the techniques used for explosively expanding the overlying layer so that the remaining portion 20*b* of the fragmented mass fills both the void space and the volume that was originally occupied by the overlying layer. Thus, by using the techniques of this invention, the remaining portion 20*b* of the fragmented mass completely fills the retort to its top boundary.

Although the principal portion 20*a* of the fragmented mass in the illustrated embodiment is "dome shaped", the techniques provided in accordance with this invention for filling such a retort to its top boundary can be used when the top surface of the fragmented mass principal portion has other shapes as well.

For purposes of exposition herein, explosive expansion of unfragmented formation used to form the principal portion of the fragmented mass is called the "primary rubblization blast" and explosive expansion of overlying unfragmented formation to form the remaining "minor" portion of the fragmented mass is called the "secondary rubblization blast".

PRIMARY RUBBLIZATION BLAST

The primary rubblization blast for forming the principal portion of the fragmented permeable mass of formation particles can be accomplished by any of a variety of techniques. Techniques, for example, such as those described in my U.S. Pat. No. 4,192,554 can be used.

Figure 2:
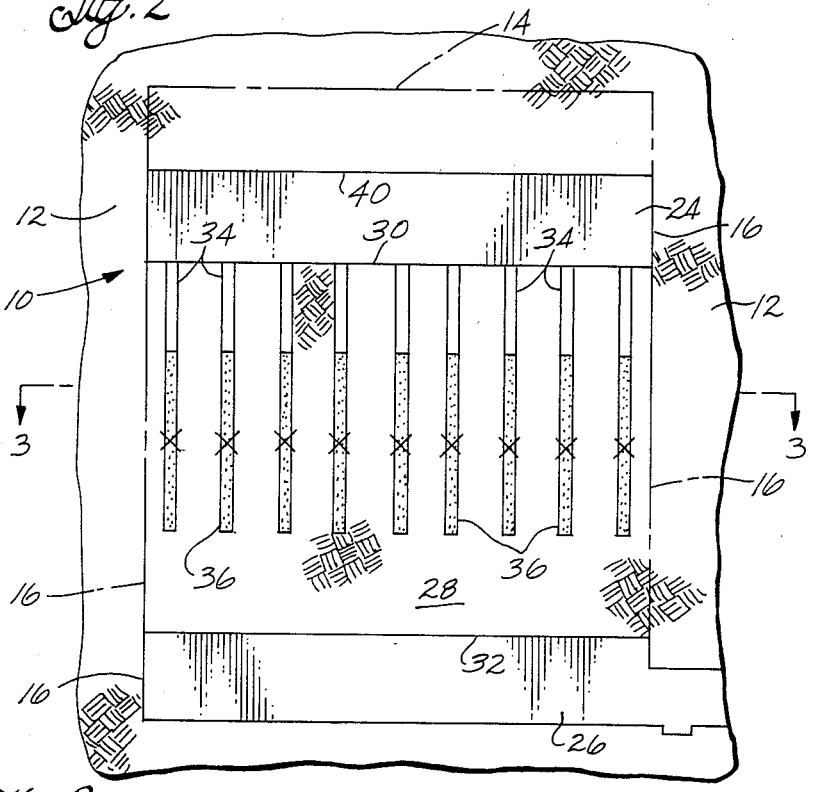
FIG. 2 is a semi-schematic, vertical, cross sectional view of the in situ oil shale retort of FIG. 1 at one stage during its preparation before the fragmented mass of formation particles has been formed.
Figure 3:
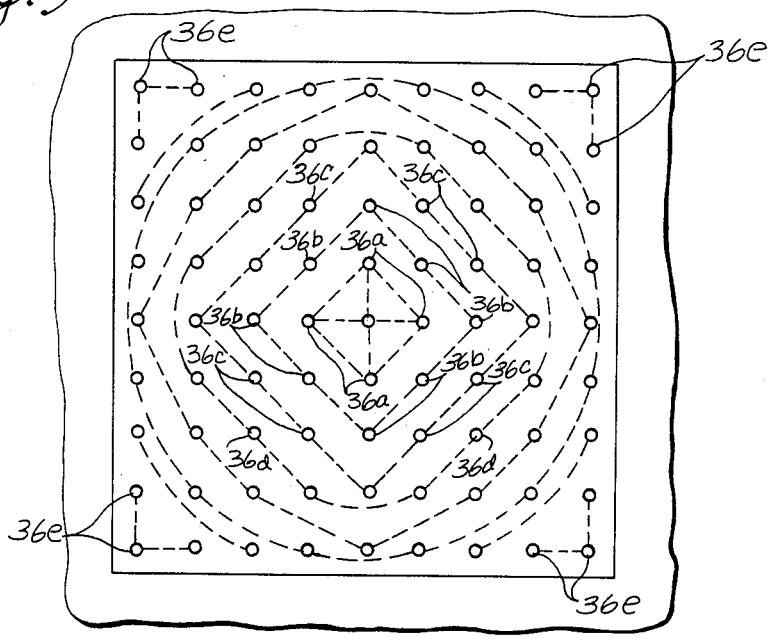
FIG. 3 is a semi-schematic horizontal cross-sectional view of the in situ oil shale retort taken on line 3—3 of FIG. 2.

One exemplary technique for forming the principal portion 20*a* of the fragmented permeable mass of formation particles can be understood by referring to FIGS. 2 and 3 which are semi-schematic vertical and horizontal cross-sectional views, respectively, of the retort 10 at one stage during its formation.

In the illustrated embodiment of the exemplary primary rubblization blast a generally horizontally extending upper void 24 and a generally horizontally extending lower void 26 are excavated into the subterranean formation 12 within the retort boundaries. The upper and lower voids are one above the other and are generally box-shaped with the side walls of the voids forming a portion of the side boundaries 16 of the retort.

A zone of unfragmented formation 28 is left within the retort boundaries and extends between the upper and lower voids. The zone of unfragmented formation 28 has a generally horizontally extending upper free face 30 which forms the floor of the void 24 and a generally horizontally extending lower free face 32 which forms the roof of the void 26.

In one embodiment, the voids 24 and 26 are of about the same size and together occupy from about 15 percent to about 40 percent of the total volume occupied by both the voids and the zone 28 of unfragmented formation. Thus, both the voids 24 and 26 are "limited voids" with respect to the volume of the zone 28 of unfragmented formation to be expanded toward the voids.

The zone of unfragmented formation 28 is prepared for explosive expansion toward the voids 24 and 26 by drilling an array of blastholes 34 into the zone 28. The array of blastholes 34 may comprise any number of rows of blastholes with any number of blastholes in each row. Similarly the blastholes may be arranged in any configuration, for example, triangular, rectangular, pentangular, and the like. The blastholes 34 are preferably drilled about three-fourths of the distance through the zone of unfragmented formation 28 from the upper void 24. Explosive is placed into each of the blastholes 34 until each blasthole is about one-third full of such explosive. A detonator designated by an "x" is placed into each blasthole at about the center of height of the zone 28 of unfragmented formation. Additional explosive is then placed into each of the blastholes 34 until each such blasthole is filled about two-thirds full of explosive, thereby forming an explosive charge 36 in each of the blastholes. The top portion of each such blasthole 34 is stemmed with an inert material such as sand or gravel (not shown). If desired, the detonators can be placed at other locations in the explosive charge, for example, near its top or bottom.

Although the exemplary embodiment of FIG. 2 shows the upper void 24 and lower void 26 substantially completely devoid of unfragmented formation, unfragmented formation can be left within such voids for forming pillars of unfragmented formation between the floor and roof for temporary support of overlying formation prior to explosive expansion. When voids are formed having pillars of unfragmented formation, the pillars are explosively expanded in the instants preceding expansion of the zone of unfragmented formation 28.

Details of explosively expanding pillars can be found in U.S. Pat. No. 4,300,800 which is incorporated herein by this reference.

The explosive charges 36 are generally vertical, horizontally spaced apart, columnar explosive charges with all of the charges preferably at about the same elevation in the retort and at about the center of elevation of the zone of unfragmented formation 28. Thus, the charges 36 form a horizontally extending array with each such charge extending about half the distance toward the free faces 30 and 32 from the center of elevation of the zone 28. As is best seen in FIG. 3, the array of explosive charges comprises a square array with the spacing distance between adjacent explosive charges being about equal in orthogonal directions, i.e., the sides of each square defined by each four adjacent blastholes or explosive charges are about equal.

In an exemplary embodiment, the explosive charges 36 are detonated in a single round time delay sequence for explosively expanding the zone of unfragmented formation 28 toward the voids 24 and 26 to thereby form the principal portion 20*a* of the fragmented permeable mass of formation particles in the retort 10.

A "single round" as used herein means detonation of a number of separate explosive charges, either simultaneously or with only a short time delay between separate detonations. A time delay between detonations in a sequence is short when formation explosively expanded by detonation of one explosive charge has either not yet moved or is still in motion at the time of detonation of a subsequent explosive charge.

Referring particularly to FIG. 3, in the illustrated embodiment the explosive charges 36*a* nearest the center of the retort 10 are detonated first with subsequent detonation of charges in bands that progress radially outwardly toward the retort side boundaries. For example, following the detonation of the charges 36*a*, the charges 36*b* in a band surrounding the charges 36*a* are detonated followed next by the charges 36*c* and the charges 36*d*. This sequence is continued until lastly the charges 36*c* in the corners are detonated. Although the exemplary embodiment includes explosive charges in the corners of the retort, such corner charges can be eliminated if desired. The explosive charges that are detonated in the same delay are shown connected by dashed lines.

Figure 4:
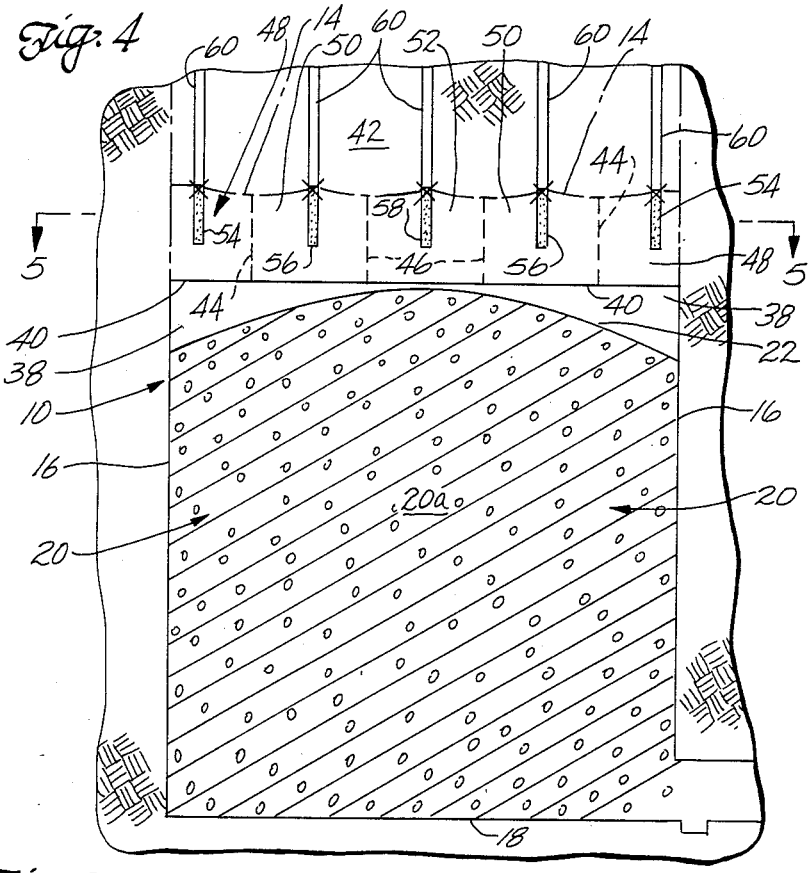
FIG. 4 is a semi-schematic, vertical, cross sectional view of the in situ oil shale retort of FIG. 1 at another stage during its preparation after a principal portion of the fragmented mass of formation particles has been formed.

Referring to FIG. 4, there is shown a semi-schematic vertical cross-sectional view of the retort 10 after the explosive charges 36 have been detonated for forming the principal portion 20*a* of the fragmented permeable mass 20 of formation particles in the retort. When a detonation sequence such as the sequence described above is used, it has been found that the fragmented mass of formation particles formed (in this case the principal portion 20*a* of the fragmented permeable mass of formation particles 20) has a mounded or domed top surface as is shown at 22 in FIG. 4 and as was described above with reference to FIG. 1. Additionally, it has been found that when such a detonation sequence is used a void space 38 is between the dome's top surface 22, and the roof 40 of the previously existing upper void 24. (Other blast patterns can also be used to provide a rubble bed with a top surface having a shape other than a dome and with a void space between the rubble surface and the roof of a previously-existing upper void.) Thus, the roof 40 is the bottom surface of a layer of unfragmented formation which overlies the principal portion 20*a* of the fragmented mass. In the illustrated embodiment the roof 40 is generally horizontal and substantially flat.

SECONDARY RUBBLIZATION BLAST

Figure 5:
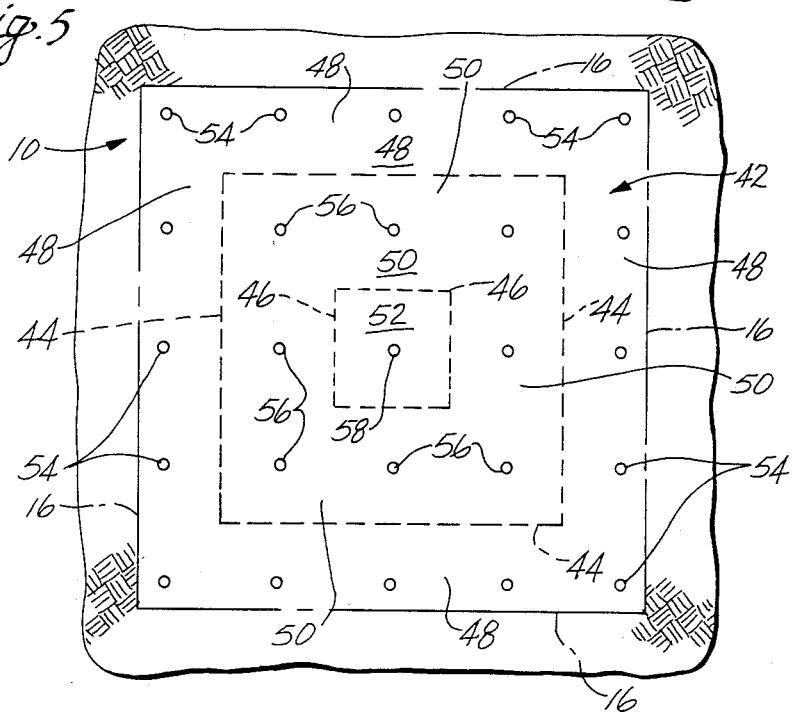
FIG. 5 is a semi-schematic, horizontal, cross sectional view of the in situ oil shale retort taken on line 5—5 of FIG. 4.

The techniques provided in accordance with practice of this invention for filling the retort 10 to its top boundary can best be understood by referring to FIGS. 4 and 5. As is described above, the retort 10 is shown in FIG. 4 after the primary rubblization blast has been completed but prior to the secondary rubblization blast. Thus, at this stage of the retort forming process the retort 10 contains the principal portion of fragmented mass 20*a* within its yet to be formed top boundary 14 (shown in phantom lines in FIG. 4), bottom boundary 18 and generally vertically extending side boundaries 16 of unfragmented formation.

The shape of the void space 38 is defined by the top surface 22 of the principal portion 20*a* of the fragmented mass, the generally horizontally extending surface 40 of overlying formation and the retort side boundaries 16. As is described below in greater detail, the surface 40 is the free face toward which at least one layer of formation overlying the void space 38 is explosively expanded during the secondary rubblization blast to fill the retort to its top boundary.

Although the techniques provided in accordance with this invention are particularly useful for explosively expanding an overlying layer having a flat, generally horizontal free face toward a void space that has an uneven shape to thereby completely fill the void space and the space occupied by the overlying layer with a fragmented mass of formation particles, such techniques are also useful when the free face is other than substantially flat and horizontal and/or the top of the rubble bed is other than mounded at the center.

In accordance with practice of this invention, after the principal portion of a fragmented mass is formed by a primary rubblization blast technique as is described above or by any of a variety of other primary rubblization blast techniques, the shape of the void space remaining between the top surface of the fragmented mass and the bottom surface of the layer of formation overlying the fragmented mass is determined. This can be accomplished, for example, by forming a plurality of horizontally spaced apart boreholes through the overlying layer into the void space. The vertical distance from the bottom of each such borehole to the top surface of the principal portion of the fragmented mass is then measured. By measuring the vertical distance from each of a plurality of locations on the free face or surface of the overlying layer to the nonlevel bottom surface of the void space, the shape of the void space is determined. Alternatively, the shape of such a void space, and thus the vertical distance from each of a plurality of locations on the free face to the nonlevel bottom surface of the void space, can be determined based on previous retort forming experience. For example, the shape of the void space can be determined by predicting the shape of the top surface of the principal portion of the fragmented mass based on the pattern of explosive charges used for the primary rubblization blast or alternatively, the shape can be determined by measuring the void space formed in a previous retort that used the same primary rubblization blast pattern that is to be used to form a subsequent retort.

In the illustrated embodiment, to determine the shape of the void space 38, a plurality of horizontally spaced apart boreholes (not shown) are formed from above through the layer 42 of formation which overlies the void space. The boreholes open into the void space and the vertical distance from the bottom of each such borehole to the top surface 22 of the principal portion 20*a* of the fragmented mass is then measured. In this instance, as is described above, it is determined that the portion 20*a* is dome shaped with its top surface 22 being at a relatively higher elevation near the horizontal center of the retort and at a continuously decreasing elevation as the surface 22 approaches the retort side boundaries 16. Thus, the void space 38 is uneven and has a relatively smaller void volume per square foot of overlying free face 40 near the center of the retort with the void volume per square foot of overlying free face increasing radially outwardly from about the retort's center.

The overlying layer 42 is then classified into a plurality of horizontally spaced regions, each of which is explosively expanded separately in a time delay sequence toward the void space 38. The classification of such a layer 42 into regions is based on the average vertical distance from the free face 40 to the top surface 22 of the fragmented mass 20*a*, i.e., it is based on the average vertical distance from the free face 40 to the bottom surface of the void space 38.

The sequence of explosive expansions of the overlying layer and the time delay between detonations are important features of this invention. For example, in a preferred sequence, the portion of the free face 40 of each region of the layer 42 that is expanded earlier in the sequence is at a greater average vertical distance from the surface 22 than the portion of the free face 40 of any such region of the layer 42 that is expanded later in the sequence. Furthermore, as is described below, preferably a time delay of sufficient duration is provided between the explosive expansions of the regions of the layer 42 to allow a new free face to form along the boundaries between adjacent regions which are expanded one after the other in the sequence.

In an exemplary sequence of explosive expansions provided in accordance with this invention, a region of the layer 42 overlying a region of the void space 38 having the largest void volume per square foot of overlying free face 40 is explosively expanded first and a region of the layer 42 overlying a region of the void space having the next largest void volume per square foot of overlying free face 40 is explosively expanded next. This sequence is continued until the region of the layer 42 overlying the region of the void space that is smallest in void volume per square foot of overlying free face is expanded. In accordance with practice of this invention, when any such subsequently expanded region is adjacent the last previously expanded region, the time delay between expansions is sufficient to allow a new free face to form at the boundary between such regions.

Thus, formation from each subsequently expanded region is directed in part vertically downwardly and in part toward the new free face, i.e., it is directed in part toward the relatively larger volume void space underlying the previously expanded region. This results in filling the void space 38 and the volume previously occupied by the overlying layer with the remaining portion 20*b* of the fragmented mass.

Referring to FIGS. 4 and 5, an exemplary embodiment of the method provided in accordance with this invention for explosively expanding the overlying layer 42 into the void space 38 to fill the retort to its top boundary can be understood.

As a first step, the overlying layer 42 is classified into regions according to the average vertical distance from the free face 40 to the surface 22 of the principal portion 20*a* of the fragmented mass. In this embodiment, in order to illustrate the techniques provided in accordance with this invention, the overlying layer 42 is classified into three regions, 48, 50, and 52.

The three regions of the layer are shown in FIGS. 4 and 5 as defined by the dashed lines 44 and 46. The first such region 48 of the layer 42 extends around the perimeter of the retort 10 and is between the dashed lines 44 and the retort side boundaries 16. The second such region 50 is adjacent the first region and extends in a band between the inner boundary of the first region 48 and the dashed lines 46. The third region 52 is at about the center of the retort and is surrounded by the region 50, i.e., the third region 52 is inside the dashed lines 46.

As can best be seen in FIG. 4, the average vertical distance from the area of the free face 40 of the region 48 to the fragmented mass surface 22 is greater than the average vertical distance from the area of the free face 40 of the region 50 to the surface 22. The average vertical distance from the area of the free face 40 of the region 52 to the surface 22 is less than the average vertical distance from the area of the free face 40 of either the first or second regions 48 and 50 respectively to the surface 22. Thus, the first region 48 extends over that portion of the void 38 that has the largest void volume per square foot of overlying free face, while the the second region 50 extends over that portion of the void having the next largest void volume per square foot of overlying free face, and the third region 52 extends over that portion of the void having the smallest void volume per square foot of overlying free face.

In accordance with this invention, the first region 48 is explosively expanded first, followed by explosive expansion of the second region 50 which in turn is followed by explosive expansion of the third region 52.

Although in the illustrated embodiment, the layer 42 is expanded toward the void in three regions, in accordance with practice of this invention the layer can be expanded in two such regions or in more than three regions, if desired. Furthermore, the layer can be expanded in regions having shapes different from the shapes of the regions 48, 50 and 52.

Once a decision is made as to the number and arrangement of the regions of the overlying layer, explosive charges are formed in each such region to provide for explosive expansion.

In the illustrated embodiment, a plurality of horizontally spaced apart explosive charges 54 are placed in the region 48 in a band near the perimeter of the retort, a plurality of horizontally spaced-apart explosive charges 56 are placed in a band within the region 50 and one or more explosive charges 58 are placed in the region 52.

In the illustrated embodiment the charges 54, 56 and 58 are formed in generally vertical blastholes 60. Thus, the charges are generally vertical, columnar charges. If desired, explosive charges having other shapes can be used.

The explosive charges 54, 56 and 58 in the blastholes 60 each has a detonator designated by an "x" placed at about its top. The locus of the tops of the charges define the top boundary 14 of the retort being formed. In the illustrated embodiment, the top boundary 14 is relatively flat and extends across the entire horizontal extent of the retort. Thus, to form the relatively flat, generally horizontal top boundary 14 the tops of all of the charges 54, 56, and 58 are at about the same elevation in the retort. If desired, to form top boundaries that are relatively more uneven, the tops of the charges can be at different elevations in the retort.

Although the length of each such charge can be as desired, each of the charges 54, 56, and 58 shown in the illustrated embodiment extends from the top boundary 14 through about half the thickness of that portion of the layer 42 being expanded. The volume or thickness of the portion of the layer 42 that is to be expanded and hence the location of the top boundary 14 are determined by the volume of the void space 38 and known bulking factors for oil shale so that when the layer 42 is expanded it completely fills the void space and the volume originally occupied by the layer with the minor portion 20*b* of the fragmented mass.

In a preferred detonation sequence provided in accordance with this invention, the explosive charges 54 in the region 48 are simultaneously detonated first to thereby explosively expand the region 48 toward the void 38. After a time delay, the charges 56 in the region 50 are simultaneously detonated to explosively expand the region 50 toward the void space 38 and, after another time delay, the charge or charges 58 in the region 52 are simultaneously detonated to expand the region 52 toward the void space 38. Preferably all of the explosive charges are detonated in the same single round. Although it is preferred that the charges in each group 54, 56, and 58 are detonated at the same time, there can be, if desired, a time delay between detonations of the charges within each such group.

As was mentioned above, the time delay between explosive expansion of each successive region of the overlying layer is a significant feature of this invention and is designed so that the formation expanded from all but the first portion is directed at least in part horizontally as well as vertically. This is accomplished by allowing a sufficient time interval between explosive expansions so that a new free face is formed at the boundary between sequentially detonated regions of the overlying layer 42.

It is thought that when a time delay of more than about 1 millisecond per foot of spacing in orthogonal directions between an explosive charge in a first region and an adjacent explosive charge in a second region, where the first and second regions are sequentially explosively expanded is used, a new free face will form between such regions. The phrase "spacing in an orthogonal direction", as used herein, means the distance between an explosive charge in one region and the nearest adjacent explosive charge in the next region expanded in the sequence. Preferably, the time delay between explosive expansions of sequential regions is from about 1 to about 10 milliseconds per foot of spacing in orthogonal directions between such adjacent explosive charges. A time delay of greater than about 10 milliseconds is not desired because such a delay can result in interaction between charges that is less than desired. More preferably, the time delay between sequential explosive expansions is from about 2 to about 5 milliseconds per foot of spacing in orthogonal directions between adjacent charges in the sequentially expanded regions. For example, having a time delay of at least 2 milliseconds ensures that the delay is sufficient to form a new vertical free face while having a time delay no longer than about 5 milliseconds ensures that proper interaction will be attained between explosive charges.

In the illustrated embodiment, for example, after the charges 54 are detonated, a time delay of from about 1 to about 10 milliseconds per foot of spacing in orthogonal directions between each such charge 54 and adjacent charge 56 is provided before the charges 56 are detonated. This provides sufficient time for a new free face to form along the boundary of the regions 48 and 50. For exemplary purposes, the new free face is shown by the dashed lines 44 in FIG. 4 and is vertical. In actual practice, it is thought that the new free face will be uneven in shape, but will tend toward vertical. Thus, when the charges 56 are detonated, the formation 50 that is expanded by the charges 56 has both a vertical component directed downwardly toward the free face 40 and a somewhat horizontal component directed toward the new free face surrounding the region 50. Therefore, a portion of the formation from the region 50 is directed generally toward the retort side boundaries. A similar 1 to 10 millisecond delay per foot of spacing between each charge 56 and an adjacent charge 58 is provided between detonation of the charges 56 and 58 in the regions 50 and 52, respectively, so that a new free face is allowed to form along the boundary of the regions 50 and 52. As was the case for the free face shown by the dashed line 44, for exemplary purposes, the new free face shown by the dashed line 46 is vertical. Thus, when the charge 58 is detonated, the formation 52 expanded by the charge 58 has both a vertical component directed downwardly toward the free face 40 and a somewhat horizontal component directed toward the new free face surrounding the region 52. Therefore, a portion of the formation from the region 52 is directed toward the retort side boundaries.

By allowing sufficient time for the new vertical free faces to form, a portion of the formation from the second and third regions 50 and 52, respectively, of the layer 42 is directed toward those portions of the void space 38 that are largest in volume.

Referring again to FIG. 1, the above described blasting technique tends to evenly distribute the void spaces through the portion 20*b* of the fragmented mass formed by explosive expansion of the overlying layer 42 so that the void space 38 and the volume originally occupied by the portion of the layer 42 that is explosively expanded is completely filled with the fragmented mass.

Although as described above, the time delay between sequential detonations during the secondary rubblization blast is preferably from about 1 to about 10 milliseconds per foot of spacing in orthogonal directions between adjacent charges in sequential regions, the preferred time delay between sequential detonations during the primary rubblization blast is shorter. For example, it is desired that the time delay between explosive expansions of sequential regions of the zone of unfragmented formation 28 be sufficiently short so that substantially no new free faces are formed during the blasting sequence. The preferred time delay between detonations in the sequence during the primary rubblization blast is from about 0.2 to about 1 millisecond per foot of spacing in orthogonal directions between adjacent charges charges in sequentially expanded regions. As a result of the short time delays, formation expanded from the zone 28 is directed only vertically toward the voids 24 and 26 and does not have a horizontal component. This results in enhanced flatness of the top surface 22 of the principal portion 20*a* of the fragmented mass and in enhanced uniformity of void fraction distribution in the rubble bed formed during the primary rubblization.

In addition to using different preferred time delays for the primary and secondary rubblization blasts, the preferred powder factor of the explosive charges used for the primary and secondary blasts is different. For example, during the primary rubblization blast, it is preferred that the powder factor is from about 1 to about 2 pounds/ton. Alternatively, it is preferred that the powder factor used for the explosive charges of the secondary rubblization blast is from about 1½ to about 3½ pounds/ton, more preferably from about 2–3 pounds/ton. Powder factor as used herein, is defined as the pounds of explosive (ANFO equivalent) used to explosively expand each ton of unfragmented formation.

It is thought that if the powder factor used for the secondary rubblization blast is less than about 1½ pounds/ton, sufficient bulking, i.e., sufficient expansion of the fragmented formation, will not take place and thus, the retort will not be completely filled to its top boundary. Additionally, it is preferred that a relatively larger powder factor be used during the secondary rubblization blast than is used during the primary rubblization blast so that the particles formed during secondary rubblization are smaller than the particles formed during the primary rubblization. Having smaller particles in the top layer of the fragmented permeable mass of formation particles enhances the ease of ignition of the retort. Conversely, if the powder factor used during the secondary rubblization is greater than about 3½ pounds/ton, problems relating to seismic effects can be greater than desired. Since more than about 3½ pounds/ton is not required for sufficient rubblization during the secondary rubblization blast, using a higher powder factor is also less economical than desired.

Although, in the illustrated embodiment the spacing between explosive charges used for the secondary rubblization blast is greater than the spacing between explosive charges used for the primary rubblization blast, other charge spacing relationships can be used. For example, it may be preferred that in addition to using a larger powder factor for the secondary rubblization blast than for the primary blast, the spacing between the explosive charges used for the secondary rubblization be less than the spacing between charges used for the primary rubblization blast. Using a smaller charge spacing for the secondary rubblization further decreases the particle size of the portion 20*b* of the fragmented mass.

Although in the illustrated embodiment of the primary rubblization blast, only two voids, i.e., the voids 24 and 26, are excavated into the formation, if desired, only one void can be used and a zone of overlying fragmented formation can be expanded downwardly toward that void in layers or lifts for forming the principal portion of the fragmented permeable mass of unfragmented formation. Alternatively, when one void is used, formation can be expanded both upwardly from a zone of unfragmented formation below the void and downwardly from the zone of unfragmented formation above the void. Also, if desired, the primary rubblization blast provided in accordance with this invention can be accomplished by expanding formation toward more than two voids excavated within the retort boundaries.

Furthermore, although the primary and secondary rubblization blasts described above are in separate rounds, if desired they can both be completed in the same single round. This can be accomplished, for example, when the shape of the void space is predicted before the blasting operation is started.

The above description of a method for forming an in situ oil shale retort that is substantially filled to its top boundary with a fragmented permeable mass of formation particles is for illustrative purposes. Because of variations which will be apparent to those skilled in the art, the present invention is not intended to be limited to the particular embodiments as described hereinabove. The scope of the invention is defined in the following claims.

What is claimed is:

1. A method for explosively expanding a layer of unfragmented formation downwardly toward a free face that overlies a void space having a nonlevel bottom surface to thereby substantially completely fill the void space and the volume originally occupied by the layer of unfragmented formation with a fragmented permeable mass of formation particles, the method comprising the steps of:

(a) determining the vertical distance from each of a plurality of locations on the free face to the nonlevel bottom surface of the void space to thereby determine the shape of the void space; and (b) explosively expanding the layer of unfragmented formation by explosively expanding a plurality of separate horizontally spaced regions within the layer of unfragmented formation in a selected sequence, there being a time delay between explosive expansions in the sequence, wherein the average vertical distance from the free face of such a region expanded earlier in the sequence to the void space bottom surface is greater than the average vertical distance from the free face of any such region expanded later in the sequence to the void space bottom surface.

2. The method according to claim 1 wherein the free face overlying the void space is generally horizontal.

3. The method according to claim 1 comprising explosively expanding the layer of unfragmented formation using explosive charges having a powder factor of from about 1½ to about 3½ pounds/ton.

4. The method according to claim 1 comprising explosively expanding the layer of unfragmented formation using explosive charges having a powder factor of from about 2 to about 3 pounds/ton.

5. A method for explosively expanding a layer of unfragmented formation downwardly toward a generally horizontal free face overlying a void space having a nonlevel bottom surface to thereby substantially completely fill the void space and the volume originally occupied by the layer of unfragmented formation with a fragmented permeable mass of formation particles, the method comprising the steps of:

(a) determining the vertical distance from each of a plurality of locations on the generally horizontal free face to the nonlevel bottom surface of the void space to thereby determine the shape of the void space;

(b) classifying the overlying layer of unfragmented formation into a plurality of separate horizontally spaced regions, the average vertical distance from the generally horizontal free face of each such region to the bottom surface of the void space being different from the average vertical distance from the generally horizontal free face of each other such region to the void space bottom surface; and (c) explosively expanding the overlying layer, region by region, with a time delay between explosive expansion of each successive region, the average vertical distance from the generally horizontal free face of each such region expanded earlier in the sequence to the void space bottom surface being greater than the average vertical distance from the generally horizontal free face of each such region expanded later in the sequence to the void space bottom surface.

6. The method according to claim 5 comprising explosively expanding the layer of unfragmented formation using a plurality of explosive charges placed into the formation, the time delay between explosive expansion of successive adjacent regions of the layer of unfragmented formation being from about 1 to about 10 milliseconds per foot of spacing distance between such an explosive charge in the first such region expanded and the nearest adjacent explosive charge in the next such region expanded.

7. The method according to claim 6 comprising explosively expanding the layer of unfragmented formation using explosive charges having a powder factor of from about $1\frac{1}{2}$ to about $3\frac{1}{2}$ pounds/ton.

8. The method according to claim 6 comprising explosively expanding the layer of unfragmented formation using explosive charges having a powder factor of from about 2 to about 3 pounds/ton.

9. The method according to claim 5 comprising explosively expanding the layer of unfragmented formation using a plurality of explosive charges placed into the formation, the time delay between explosive expansion of successive adjacent regions of the layer of unfragmented formation being from about 2 to about 5 milliseconds per foot of spacing distance between such an explosive charge in the first such region expanded and the nearest adjacent explosive charge in the next such region expanded.

10. A method for explosively expanding a layer of unfragmented formation downwardly toward a generally horizontal free face overlying a void space having a nonlevel bottom surface to thereby substantially completely fill the void space and the volume originally occupied by the layer of unfragmented formation with a fragmented mass of formation particles, the method comprising the steps of:

(a) determining the vertical distance from each of a plurality of locations on the generally horizontal free face to the nonlevel bottom surface of the void space to thereby determine the shape of the void space bottom surface;

(b) classifying the overlying layer of unfragmented formation into at least two separate horizontally spaced regions, the generally horizontal free face of a first such region being a first average vertical distance from the void space bottom surface and the generally horizontal free face of a second such region being a second average vertical distance from the void space bottom surface, the first average distance being greater than the second average distance;

(c) explosively expanding the first region of the layer toward the void space; and after a selected time delay (d) explosively expanding the second region of the layer toward the void space.

11. The method according to claim 10 comprising explosively expanding the layer of unfragmented formation by placing explosive charges in each such region of the layer and detonating the explosive charges, the time delay between explosive expansion of the first region of the layer and explosive expansion of the second region of the layer being from about 1 to about 10 milliseconds per foot of spacing distance between such an explosive charge in the first region and the nearest adjacent explosive charge in the second region.

12. The method according to claim 10 comprising explosively expanding the layer of unfragmented formation by placing explosive charges in each such region of the layer and detonating the explosive charges, the time delay between explosive expansion of the first region of the layer and explosive expansion of the second region of the layer being from about 2 to about 5 milliseconds per foot of spacing distance between such an explosive charge in the first region and the nearest adjacent explosive charge in the second region.

13. The method according to claim 10 comprising explosively expanding the layer of unfragmented formation using explosive charges having a powder factor of from about $1\frac{1}{2}$ to about $3\frac{1}{2}$ pounds/ton.

14. The method according to claim 10 comprising explosively expanding the layer of unfragmented formation using explosive charges having a powder factor of from about 2 to about 3 pounds/ton.

15. A method for forming an in situ oil shale retort in a retort site in a subterranean formation containing oil shale, the in situ retort containing a fragmented permeable mass of formation particles within top, bottom, and generally vertically extending side boundaries of unfragmented formation, the method comprising the steps of:

(a) forming a lower portion of the fragmented permeable mass of formation particles having a nonlevel top surface while leaving a void space within the retort boundaries extending between the nonlevel top surface of the fragmented mass lower portion and a generally horizontally extending free face of an overlying layer of unfragmented formation; and thereafter (b) explosively expanding the overlying layer of unfragmented formation toward the void space to thereby form the remaining portion of the fragmented permeable mass in the retort, the overlying layer expanded in at least two separate horizontally spaced regions with a time delay between explosive expansion of such regions, the region first expanded having a generally horizontal free face that is a first average vertical distance from the nonlevel top surface of the lower portion of the fragmented mass and the region next expanded having a generally horizontal free face that is a second average vertical distance from the nonlevel top surface of the lower region of the fragmented mass, the first average distance being greater than the second average distance.

16. The method according to claim 15 comprising explosively expanding the overlying layer of unfragmented formation in a single round time delay sequence.

17. The method according to claim 15 comprising explosively expanding the layer of unfragmented formation by placing explosive charges in each such region of the layer and detonating the explosive charges, the time delay between the explosive expansion of such a region first expanded and the explosive expansion of such an adjacent region next expanded being from about 1 to about 10 milliseconds per foot of spacing distance between an explosive charge in the region first expanded and the nearest adjacent explosive charge in the region next expanded.

18. The method according to claim 17 comprising explosively expanding the layer of unfragmented formation using explosive charges having a powder factor of from about $1\frac{1}{2}$ to about $3\frac{1}{2}$ pounds/ton.

19. The method according to claim 17 comprising explosively expanding the layer of unfragmented formation using explosive charges having a powder factor of from about 2 to about 3 pounds/ton.

20. The method according to claim 15 comprising explosively expanding the layer of unfragmented formation by placing explosive charges in each such region of the layer and detonating the explosive charges, the time delay between the explosive expansion of the region first expanded and the explosive expansion of an adjacent region next expanded being from about 2 to about 5 milliseconds per foot of spacing distance between an explosive charge in the region first expanded and the nearest adjacent explosive charge in the region next expanded.

21. A method for forming an in situ oil shale retort in a retort site in a subterranean formation containing oil shale, the in situ retort containing a fragmented permeable mass of formation particles within top, bottom, and generally vertically extending side boundaries of unfragmented formation, the method comprising the steps of:

(a) forming a lower portion of the fragmented permeable mass of formation particles in the retort having a nonlevel top surface while leaving a void space within the retort boundaries extending between the nonlevel top surface of the fragmented mass lower portion and a generally horizontally extending free face of an overlying layer of unfragmented formation; and thereafter (b) explosively expanding the overlying layer of unfragmented formation toward the void space to thereby form the remaining portion of the fragmented permeable mass in the retort, wherein the overlying layer is expanded in a plurality of separate horizontally spaced regions with a time delay between explosive expansion of each successive region, the average vertical distance from the generally horizontal free face of each such region of the layer expanded earlier in the sequence to the nonlevel top surface of the lower portion of the fragmented mass being greater than the average vertical distance from the generally horizontal free face of each such region expanded later in the sequence to the nonlevel top surface of the lower portion of the fragmented mass.

22. The method according to claim 21 comprising explosively expanding the layer of unfragmented formation using explosive charges placed into said layer of unfragmented formation and having a powder factor of from about 1½ to about 3½ pounds/ton.

23. The method according to claim 21 comprising explosively expanding the layer of unfragmented formation using explosive charges placed into said layer of unfragmented formation and having a powder factor of from about 2 to about 3 pounds/ton.

24. The method according to claim 21 comprising explosively expanding the layer of unfragmented formation by placing explosive charges in each such region and detonating the explosive charges, the time delay between explosive expansion of successive adjacent regions being from about 1 to about 10 milliseconds per foot of spacing distance between such an explosive charge in the first such region expanded and the nearest adjacent explosive charge in the next such region expanded.

25. The method according to claim 21 comprising explosively expanding the layer of unfragmented formation by placing explosive charges in each such region and detonating the explosive charges, the time delay between explosive expansion of successive adjacent regions being from about 2 to about 5 milliseconds per foot of spacing distance between such an explosive charge in the first such region expanded and the nearest adjacent explosive charge in the next such region expanded.

26. A method for forming an in situ oil shale retort in a retort site in a subterranean formation containing oil shale, the in situ retort containing a fragmented permeable mass of formation particles containing oil shale within top, bottom, and generally vertically extending side boundaries of unfragmented formation, the method comprising the steps of:

(a) excavating at least one void in the subterranean formation within the retort boundaries, while leaving a zone of unfragmented formation within the retort boundaries having a free face adjacent such a void;

(b) placing an array of a plurality of spaced-apart explosive charges in such a zone of unfragmented formation;

(c) detonating the explosive charges for explosively expanding the zone of unfragmented formation toward the void to thereby form a lower portion of the fragmented permeable mass of formation particles in the retort having a nonlevel top surface while leaving a void space within the retort boundaries extending between the nonlevel top surface of the fragmented mass lower portion and a generally horizontally extending free face of an overlying layer of unfragmented formation;

(d) placing an array of a plurality of horizontally spaced apart explosive charges in the overlying layer of unfragmented formation; and (e) detonating the explosive charges in the overlying layer of unfragmented formation for explosively expanding the overlying layer toward the void space to thereby form the remaining portion of the fragmented permeable mass in the retort, the overlying layer explosively expanded in at least two separate horizontally spaced adjacent regions with a time delay between detonation of the explosive charges in each such adjacent region, the region first expanded having a generally horizontal free face that is a first average vertical distance from the nonlevel top surface of the lower portion of the fragmented mass and the region next expanded having a generally horizontal free face that is a second average vertical distance from the nonlevel top surface of the lower portion of the fragmented mass, the first average distance being greater than the second average distance.

27. The method according to claim 26 wherein the explosive charges in the zone of unfragmented formation have a powder factor of from about 1 to about 2 pounds/ton and the explosive charges in the overlying layer of unfragmented formation have a powder factor of from about 1½ to about 3½ pounds/ton.

28. The method according to claim 27 wherein the explosive charges in the overlying layer of unfragmented formation have a powder factor of from about 2 to about 3 pounds/ton.

29. The method according to claim 26 wherein the time delay between explosive expansion of the region of the overlying layer first expanded and explosive expansion of the region of the overlying layer next expanded is from about 1 to about 10 milliseconds per foot of spacing distance between an explosive charge in the region first expanded and the nearest adjacent explosive charge in the region next expanded.

30. The method according to claim 26 wherein the time delay between explosive expansion of the region of the overlying layer first expanded and explosive expansion of the region of the overlying layer next expanded is from about 2 to about 5 milliseconds per foot of spacing distance between an explosive charge in the region first expanded and the nearest adjacent explosive charge in the region next expanded.

31. A method for forming an in situ oil shale retort in a retort site in a subterranean formation containing oil shale, the in situ retort containing a fragmented permeable mass of formation particles containing oil shale within top, bottom, and generally vertically extending side boundaries of unfragmented formation, the method comprising the steps of:

(a) excavating at least one void in the subterranean formation within the retort boundaries, while leaving a zone of unfragmented formation within the retort boundaries having a generally horizontally extending free face adjacent such a void;

(b) placing an array of a plurality of horizontally spaced apart explosive charges in such a zone of unfragmented formation;

(c) detonating the explosive charges for explosively expanding the zone of unfragmented formation toward the void to thereby form a lower portion of the fragmented permeable mass of formation particles in the retort having a nonlevel top surface while leaving a void space within the retort boundaries extending between the nonlevel top surface of the fragmented mass lower portion and a generally horizontally extending free face of an overlying layer of unfragmented formation;

(d) placing an array of a plurality of horizontally spaced apart explosive charges in the overlying layer of unfragmented formation; and (e) detonating the explosive charges in the overlying layer of unfragmented formation for explosively expanding the overlying layer toward the void space to thereby form the remaining portion of the fragmented mass in the retort, the overlying layer expanded in a plurality of separate horizontally spaced regions with a time delay between detonation of explosive charges in each successive region, the average vertical distance from the generally horizontal free face of each such region of the layer expanded earlier in the sequence to the nonlevel top surface of the lower portion of the fragmented mass being greater than the average vertical distance from the generally horizontal free face of each such region expanded later in the sequence to the nonlevel top surface of the lower portion of the fragmented mass.

32. The method according to claim 31 wherein the explosive charges in the zone of unfragmented formation have a powder factor of from about 1 to about 2 pounds/ton and the explosive charges in the overlying layer of unfragmented formation have a powder factor of from about $1\frac{1}{2}$ to about $3\frac{1}{2}$ pounds/ton.

33. The method according to claim 32 wherein the explosive charges in the overlying layer of unfragmented formation have a powder factor of from about 2 to about 3 pounds/ton.

34. The method according to claim 31 wherein the time delay between explosive expansion of successive adjacent regions of the overlying layer of unfragmented formation is from about 1 to about 10 milliseconds per foot of spacing distance between such an explosive charge in the first region expanded and the nearest adjacent explosive charge in the next region expanded.

35. The method according to claim 31 wherein the time delay between explosive expansion of successive adjacent regions of the overlying layer of unfragmented formation is from about 2 to about 5 milliseconds per foot of spacing distance between such an explosive charge in the first region expanded and the nearest adjacent explosive charge in the next region expanded.

36. The method according to claim 31 wherein the array of explosive charges in the zone of unfragmented formation is a square array and such charges are detonated in a single round time delay sequence, the time delay between detonations in the sequence being from about 0.2 to about 1.0 milliseconds per foot of spacing distance between adjacent charges.

* * * * *